US005398733A

United States Patent [19]

Welch

[11] Patent Number: 5,398,733

[45] Date of Patent: Mar. 21, 1995

[54] READILY CLEANED LIQUID TRANSFER SYSTEM

[75] Inventor: Elmer S. Welch, Silver Lake, Wis.

[73] Assignee: VQ Corporation, Silver Lake, Wis.

[21] Appl. No.: 209,440

[22] Filed: Mar. 10, 1994

[51] Int. Cl.[6] ..... B65B 31/00

[52] U.S. Cl. ..... 141/4; 141/5; 141/65; 141/70; 137/3; 137/89; 366/136; 366/159; 222/464

[58] Field of Search ..... 141/1, 4, 5, 7, 65, 141/67, 98, 70; 137/3, 88, 89, 110; 366/136, 163, 199; 222/148, 464, 318; 99/275

[56] References Cited

U.S. PATENT DOCUMENTS

| | | | |
|---|---|---|---|
| 3,583,415 | 6/1971 | Smith | 137/3 |
| 3,829,024 | 8/1974 | Heden | 137/110 X |
| 4,007,921 | 2/1977 | Zingg | 366/136 X |
| 4,171,710 | 10/1979 | Boynton et al. | 137/238 |
| 4,202,364 | 5/1980 | Karr | 137/13 |
| 4,299,501 | 11/1981 | Patil et al. | 366/136 X |
| 4,542,275 | 9/1985 | Beck | 141/65 |
| 4,738,478 | 4/1988 | Bean, Jr. | 294/55 |
| 4,747,701 | 5/1988 | Perkins | 383/33 |
| 4,941,593 | 7/1990 | Hicks et al. | 222/148 |
| 4,953,704 | 9/1990 | Cortese | 206/493 |
| 4,980,017 | 12/1990 | Kaji et al. | 137/88 X |
| 5,040,902 | 8/1991 | Eaton et al. | 383/7 |
| 5,074,670 | 12/1991 | Paul | 366/136 X |
| 5,120,138 | 6/1992 | Midgley et al. | 383/7 |
| 5,133,607 | 7/1992 | Bonke | 383/75 |
| 5,174,354 | 12/1992 | Nesser et al. | 141/5 |
| 5,222,529 | 6/1993 | Zoltan et al. | 141/4 |
| 5,232,118 | 8/1993 | Samuel | 220/404 |
| 5,234,035 | 8/1993 | Nesser | 141/1 |
| 5,246,287 | 9/1993 | Isherwood et al. | 366/136 X |
| 5,247,957 | 9/1993 | Weisse | 137/3 |
| 5,348,390 | 9/1994 | Scheitealieb | 366/159 X |

FOREIGN PATENT DOCUMENTS 1498403 2/1969 Germany .

OTHER PUBLICATIONS

Three-page bulletin by Penberthy, "Jet Pump Technical Data Pumping Liquids", issued May 1987.

Two-page article entitlted "Jet Pumps" by John A. Reynolds, reprinted from Pumps and Systems Magazine, dated Oct., 1993.

*Primary Examiner*—Ernest G. Cusick

*Attorney, Agent, or Firm*—Dressler, Goldsmith, Shore & Milnamow, Ltd.

[57] ABSTRACT

A readily cleaned liquid transfer system is designed for use with an associated vessel or container, such as a barrel, having therein a liquid to be removed. The system comprises a recirculation loop, a transfer manifold, and a transfer hose for providing flow communication between the transfer manifold and the recirculation loop. The transfer manifold has an inlet port which is located at about the bottom of the barrel, and an outlet port. The recirculation loop which has water flowing therethrough which is used as a diluent, also includes an eductor pump. The eductor pump hydrodynamically drives or draws the liquid in the barrel, through the transfer manifold and the transfer hose, into the recirculation loop. The recirculation loop discharges a blended product to a product tank.

13 Claims, 3 Drawing Sheets

READILY CLEANED LIQUID TRANSFER SYSTEM

FIELD OF THE INVENTION

This invention pertains to systems for transferring a liquid from a container or vessel to another container or vessel. More particularly, this invention pertains to a barrel transfer system which utilizes a motive pump and an eductor to transfer liquid from a barrel, and which system can be readily cleaned in place.

BACKGROUND OF THE INVENTION

Liquids, such as juices and the like, are often packaged by a producer in concentrated form. Packaging for such liquids typically includes a barrel or a drum, and a flexible plastic liner which is appropriately sized to fit within the barrel or drum. Packaging such products in a concentrated form tends to reduce the overall product cost because the reduced volume results in lower packaging and shipping costs. Typically, the concentrated liquid is reconstituted by blending with water and packaged for end use, such as by a consumer, at a bottling or packaging plant.

Not uncommonly, such concentrates are packaged or shipped in large vessels or containers, such as those mounted on truck beds or rail cars, when transported in large volumes.

To transfer the liquid or juice concentrate from a barrel to a handling operation, bottling plants may use manual labor or pumping operations employing positive displacement pumps. Manual labor can be costly and inefficient. Concentrate or product may be spilled or contaminated which must be discarded as waste. Increased direct transfer reduces the potential for such spillage or waste.

In a typical bottle or packaging operation, concentrate is transferred to a batch tank, the concentrate in the batch tank is then blended with a diluent, such as water, in accordance with predetermined dilution ratios. The product, such as juice product, is then sampled and tested. As required, adjustments are made to the product. Manual checks of the equipment, the operations, and the final product quality are performed throughout.

Positive displacement pumps also have some drawbacks. Namely, such pumps tend to rapidly wear when used in concentrated juice systems because of the abrasive nature of the concentrates.

SUMMARY OF THE INVENTION

A barrel transfer system is provided which comprises a recirculation loop, a transfer manifold, and means for providing flow communication therebetween. The recirculation loop includes a recirculation pump, an eductor pump, and a separator. The recirculation pump is a motive pump and is arranged to discharge a liquid through the eductor pump into the separator. The recirculation pump is supplied with liquid from the separator.

The transfer manifold has an inlet port and an outlet port, and a fluid conduit for providing flow communication between the inlet port and the outlet port. The inlet port is disposed in a barrel at about the bottom thereof and is formed to define a plurality of fluid passages between the inlet port and the bottom of the barrel.

The system further includes means for providing flow communication between the outlet port of the transfer manifold and the recirculation loop, wherein the liquid in the recirculation loop is discharged from the recirculation pump, through the eductor pump, to provide a dynamic head to draw liquid from the barrel through the transfer manifold and into the recirculation loop.

In a preferred embodiment of the transfer system, the transfer manifold includes a concave dish shaped portion extending radially from about the inlet port. The dish shaped portion is positioned to rest against the bottom of the barrel, and is shaped to define a plurality of fluid passages between the inlet port and the bottom of the barrel.

In a more preferred embodiment, the inlet port is frusto-conically shaped.

Preferably, the dish-shaped portion of the transfer manifold has a cone-shaped hub, a generally circular outer member, and a plurality of arcuate, upwardly extending, spoke-like members extending between the conical-shaped hub and the circular outer member. The spoke-like members define a fluid passage between each spoke-like member and an adjacent spoke-like member.

Optionally, the transfer system further includes a spray header adjustably mounted to the fluid conduit between the inlet port and the outlet port, the spray header being positionable to provide a spray of fluid therefrom.

In an embodiment of the transfer system wherein the barrel has therein a liner, the system further includes an elastomeric band placed over the liner, the liner being in contact with the barrel, so that the elastomeric band secures the liner to the barrel.

An embodiment of the transfer system which is for use with a first associated vessel or container, having therein a liquid to be transferred to a second associated vessel or container comprises a recirculation loop, and first and second means for flow communication with the recirculation loop. The recirculation loop includes a recirculation pump, an eductor pump, and a separator. The recirculation pump is a motive pump and is arranged to discharge a liquid through the eductor pump into the separator. The recirculation pump is supplied with liquid from the separator. This embodiment further includes first means for providing flow communication between the first associated vessel or container and the recirculation loop, and second means for providing flow communication between the recirculation loop and the second associated vessel or container.

In this embodiment, the liquid in the recirculation loop is discharged from the recirculation pump through the eductor to provide a dynamic head to draw liquid from the first associated vessel or container into the recirculation loop. The liquid in the recirculation loop fills the separator and is discharged from the separator to the second associated container. In a preferred embodiment of the transfer system, the first means for providing flow communication is a hose. Preferably, the second means for providing the flow communication is interconnecting piping.

The invention also contemplates a method of transferring a liquid from within a barrel, comprising the steps of providing a barrel having therein a liquid, and providing a barrel transfer system having a transfer manifold, a recirculation loop including a recirculation pump, an eductor pump, and a separator, and means for flow communication between the transfer manifold and the recirculation loop. The method includes pumping a liquid through the recirculation loop, from the recirculation pump, through the eductor pump, and into the separator, wherein the pumping creates a low-pressure region in the eductor. The method further includes drawing the liquid from the barrel into the low-pressure region of the eductor, mixing the liquid from the barrel with the liquid in the recirculation loop to form a blended product, and discharging the blended product from the recirculation loop.

Herein, references to a barrel are intended to refer generally to a steel, polymeric, or fibrous barrel, drum, box, or other container used to contain juice concentrates, other liquid concentrates, viscous food products, such as tomato ketchup, and the like.

Other features and advantages of the present invention will be apparent from the following detailed description, the accompanying drawings, and the appended claims.

DETAILED DESCRIPTION OF THE EMBODIMENTS

Figure 1:
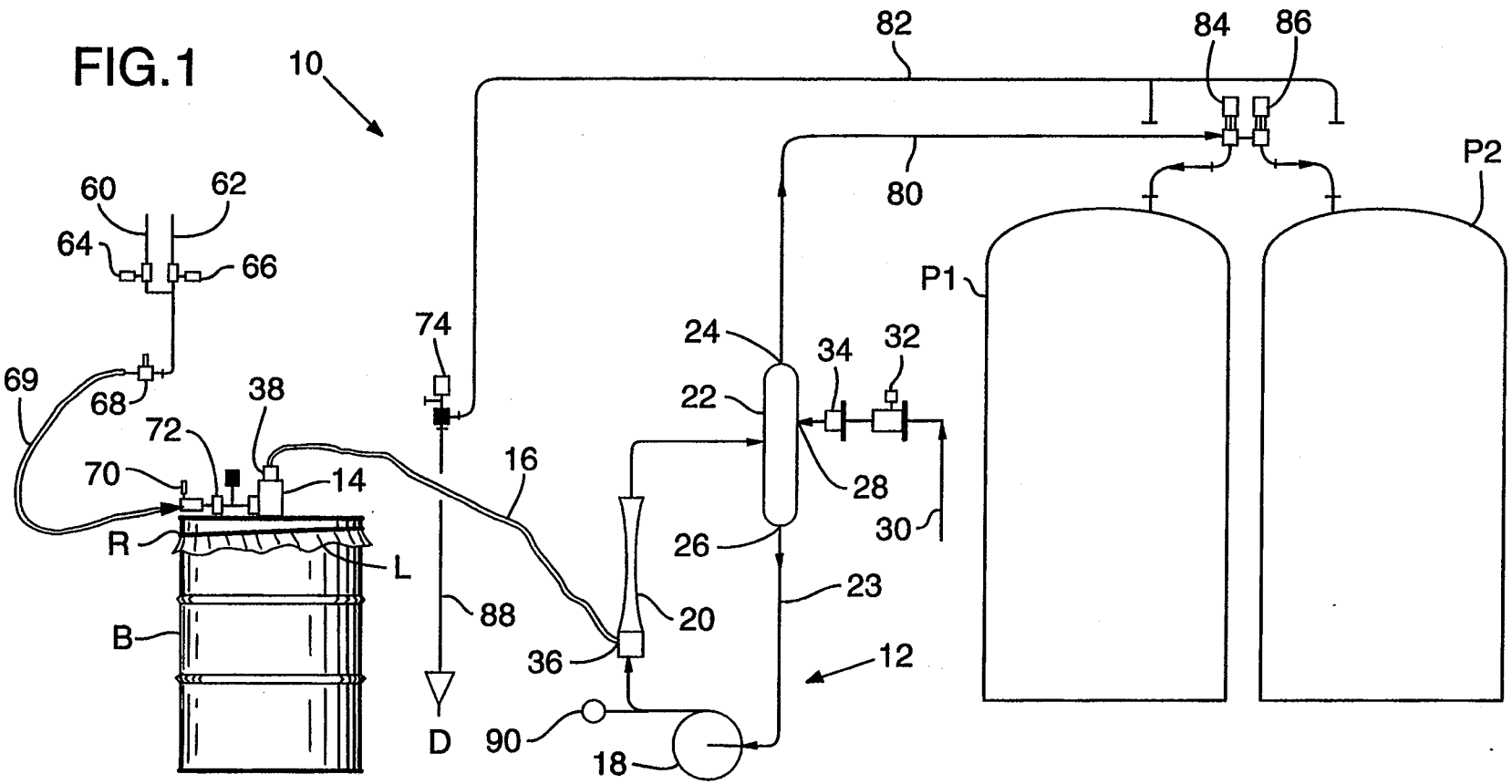
FIG. 1 is a simplified flow diagram of an exemplary barrel transfer system in the concentrate transfer mode, which system embodies the principles of the present invention.

With reference now to the drawings, and particularly to FIG. 1, there is shown an embodiment of the system of the present invention, as incorporated in a barrel transfer system 10, which comprises, generally, a recirculation loop 12, and means for providing flow communication between an associated container or vessel and the recirculation loop 12, such as the exemplary transfer manifold 14 and the exemplary transfer hose 16. The illustrated embodiment of the system 10 is used in association with a barrel B, which in a typical use has a liner L, in which the liquid to be removed or transferred is stored.

The recirculation loop 12 includes a recirculation pump 18, which is a motive pump, an eductor pump 20, and a separator 22. The loop is configured such that the recirculation pump 18 discharges into and through the eductor pump 20. The outlet of the eductor pump 20 is directed to the separator 22. The outlet stream 23 from the separator 22 is routed to supply the recirculation pump 18. Interconnecting piping provides flow communication between the recirculation pump 18 and the eductor pump 20, the eductor pump 20 and the separator 22, and the separator 22 and the recirculation pump 18.

A brief explanation of the eductor pump is to be next provided, the details and applications of which will be readily understood by those skilled in the art. It is to be understood that the eductor pump, as a component, is outside of the scope of the present invention.

Generally, the eductor pump has three ports, namely, an inlet port at one end, a discharge port at the opposite end thereof, and a suction port disposed therebetween. Typically, the suction port enters the eductor body so as to be substantially perpendicular to the flow path between the inlet and outlet ports. A nozzle is disposed between the inlet and outlet ports adjacent to, and upstream of, the suction port. In operation, a high pressure liquid is pumped, such as by a centrifugal pump, into the inlet port. The liquid flows through the nozzle and discharges from the eductor at the discharge port. The pressure drop at the nozzle causes a low pressure region immediately downstream thereof in the area of the suction port. The low pressure region creates a driving force for the liquid at the suction port to enter the eductor, mix with the flowing liquid in the low pressure region, and be carried out of the eductor with the flowing liquid through the discharge port.

In this embodiment, the eductor 20 is installed such that the recirculation pump 18 discharges into the eductor 20 inlet port. The discharge from the eductor 20 outlet port is directed to the separator 22. The eductor suction port, as shown at 36, is operably connected to the transfer manifold 14 via the transfer hose 16.

The separator 22 has a top discharge port 24, a bottom discharge port 26, and a priming port 28. The top discharge port 24 is connected, via piping, to provide flow communication through the pilot-solenoid operated selector valves 84, 86, to the product vessels P1, P2. In an embodiment of the system 10, the separator 22 inlet from the eductor is tangentially configured so as to impart a swirling motion to the entering liquid. The swirling motion facilitates separating the entering liquid from any air which may be entrained in the liquid.

Priming water is provided to the system 10 from a water source through a priming line 30, an on-off valve, such as the exemplary air-actuated valve 32, and a check valve 34, and into the separator 22 through priming port 28. The priming water is also the diluent which is used to reconstitute the concentrate into the blended product.

The eductor suction port 36 is connected to the transfer manifold 14 via the exemplary transfer hose 16.

Figure 3:
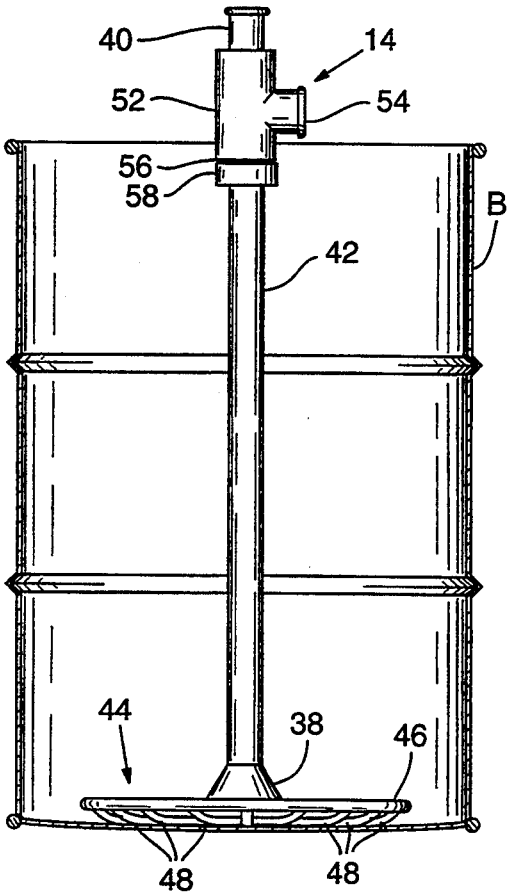
FIG. 3 is a partially broken away, elevational view of a barrel showing therein an exemplary transfer manifold.
Figure 5:
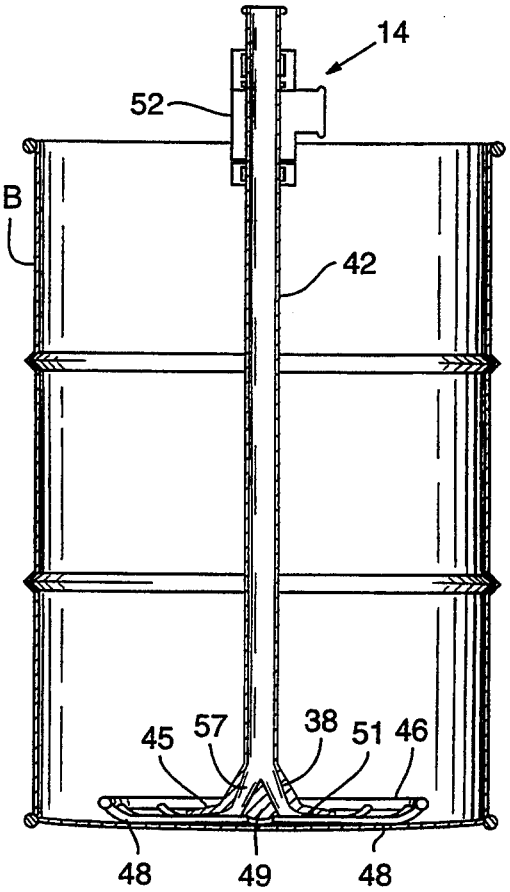
FIG. 5 is a view similar to FIG. 3 shown in cross section.
Figure 4:
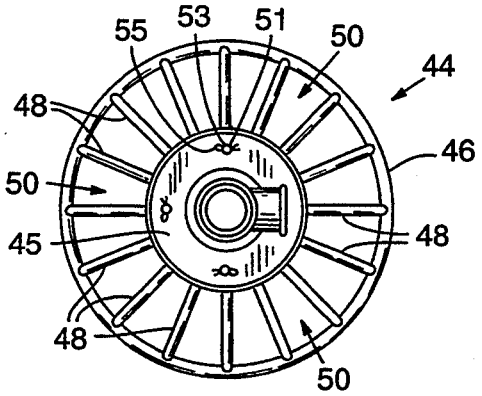
FIG. 4 is a top view of the transfer manifold illustrated in FIG. 3.

With reference now to FIGS. 3, 4, and 5, the transfer manifold 14 has an inlet port 38, an outlet port 40, and a fluid conduit 42 for providing flow communication between the inlet and outlet ports 38, 40.

In a preferred embodiment, the transfer manifold 14 includes a concave, dish-shaped portion 44 positioned adjacent the inlet port 38. The inlet port 38 has a frustoconical shape and terminates in a flange 45. The dish-shaped portion 44, which is separable from the inlet port 38, extends radially from the inlet port 38 and defines a relatively flat, stable area to rest on the bottom of the barrel B.

As best seen in FIG. 4, the dish-shaped portion 44 is formed of a circular outer member 46 and a plurality of arcuate, upwardly extending, spoke-like members 48. The spoke-like members 48 extend between the circular outer member 46 and a central, cone-shaped hub 49. The spoke-like members 48 extend upwardly relative to the manifold 14 when the manifold 14 is positioned in a barrel B, as shown in FIGS. 3 and 5. In a preferred embodiment of the manifold 14, the circular outer member 46 and the spoke-like members 48 are formed of bent or formed rod.

The spoke-like members 48 are positioned to define a plurality of fluid passages, indicated at 50 in FIG. 4, between each spoke-like member 48 and its adjacent spoke-like members 48. The dish-shaped portion 44 is retained in place on the manifold 14 by a plurality of pins 51 which extend upwardly from the dish-shaped portion 44 and through apertures 53 in the flange 45. Clips 55 secure the pins 51 to the flange 45.

As assembled, as best seen in FIG. 5, the configuration of the central, cone-shaped hub 49 which is positioned in the frusto-conical inlet port 38, defines an annular flow passage, indicated at 57. The flow area of annular flow passage 57 is substantially constant along its length.

Figure 2:
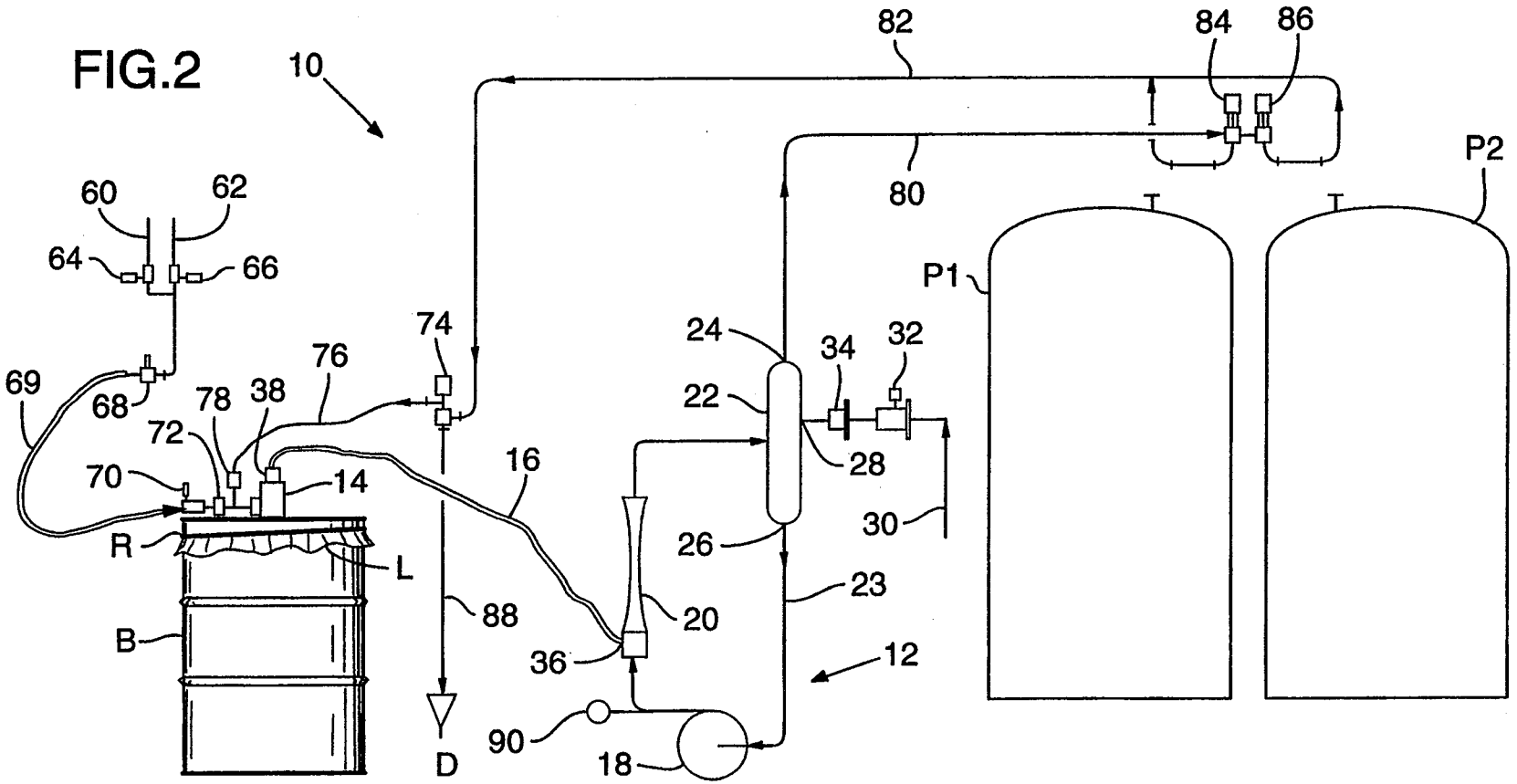
FIG. 2 is a simplified flow diagram of the system illustrated in FIG. 1 in which the system is operating in the cleaning mode.

In a more preferred embodiment, the transfer manifold 14 further includes a spray header 52 adjustably mounted to the fluid conduit 42, between the inlet port 38 and the outlet port 40. The spray header 52 is mounted to the fluid conduit by means, such as adjustable screws (not shown), which means will be readily recognized by those skilled in the art. The spray header 52 has a spray inlet 54, and a spray nozzle 56, which extends circumferentially about the spray header 52. In a preferred construction, the nozzle 56 further includes a nozzle block 58 which is adjustable relative to the spray header 52. The adjustable nozzle block 58 permits adjustment of the spray intensity, vis-a-vis flow and pressure, by increasing or decreasing the flow area of the nozzle 56. As best seen in FIGS. 1 and 2, the transfer manifold outlet port 40 is connected to the eductor suction port 36 by the exemplary transfer hose 16. It is contemplated that other means for providing flow communication between the transfer manifold 14 and the suction port 36 may also be used, such means including tubing, piping, and the like.

Ancillary to the system 10, water may be supplied to the system 10, through hot and cold water supply lines 60, 62, on-off valves, such as the exemplary air-actuated valves 64, 66, and the pressure-reducing valve 68. A hose 69 provides a flow path to the spray inlet 54, through an on-off valve, such as the exemplary air-actuated valve 70, and a check valve 72. To facilitate cleaning of the system 10, the barrel B, and the product and the cleaning return lines 80, 82, the system 10 may also include, as shown in FIG. 2, a cleaning recirculation valve, such as the exemplary three-way air-actuated valve 74, a recirculation hose 76, and a recirculation check valve 78. The system 10 is connected to product vessels P1, P2, via product line 80 and cleaning return line 82, through selector valves, such as the exemplary air-actuated valves 84, 86. A system drain line 88 is routed from the cleaning recirculation valve 74 to the drain D. Typically, an air gap is provided between the line 88 and the drain D.

It is contemplated that the present system 10 will operate in two modes, namely a concentrate transfer mode and a cleaning mode. The transfer mode is shown in FIG. 1 in which the liquid flow path is indicated by darkened arrows, by operable valves which are open when shown unshaded, and by conversely operable valves which are closed when shown shaded.

The operation of the present system 10 will be described in which the concentrated juice or concentrate is provided in a barrel B, which has therein a liner L in which the concentrate is shipped and stored. In a typical arrangement in which the liner L is used, the liner L is formed of a flexible polymeric material, such as polyethylene and the like.

In preparation of the transfer operation, a tie is removed from the liner L, and the liner L is pulled upward and over the rim of the barrel B. As shown in FIGS. 1 and 2, the top of the liner L is pulled downward over the outside of the barrel B. An elastomeric retention band R is placed over the liner L to secure it to the barrel B.

The transfer manifold 14 is placed in the barrel B, such that the dish-shaped portion 44 rests against the bottom of the barrel B, and holds the liner L in place. In a typical arrangement, the transfer hose 16, as well as the water supply hose 69 would be connected at their terminal ends during operational periods and non-operational periods, and the transfer manifold 14 would be placed into the barrel B with the hose 16, 69, connections made in advance. This results in less spillage and waste.

The recirculation loop 12 is primed with water through the priming line 30. The priming water enters the loop 12 through the separator priming port 28. The water flows to the bottom of the separator 22 and provides a supply of water to the recirculation pump 18. The recirculation pump 18 is then started, while the priming line 30 continues to supply water to the loop 12. A pressure indicator 90 or other sensing means, which is located at the outlet of the recirculation pump 18 is monitored. When the pressure indicator 90 or other sensing means indicates that the pressure in the loop 12 is consistent, the priming line 30 is isolated by closing the on-off valve 32.

With the priming line 30 isolated, and the recirculation pump 18 operating, the recirculation loop 12 is hydrodynamically balanced, that is, there is no discharge from the loop 12. The liquid which is discharged from the recirculation pump 18, through the eductor 20, creates a low-pressure region in the eductor 20 at the suction port 36. This low-pressure region hydrodynamically drives or draws concentrate from the barrel B, through the transfer manifold 14, and the transfer hose 16 into the eductor suction port 36. The concentrate mixes with the liquid in the recirculation loop 12, in the eductor 20, to form a less concentrated, blended product.

Essentially, the priming water serves as a diluent to the concentrate to produce the blended product. The blended product enters the separator 22 where a portion of the blended product flows to the bottom of the separator 22, is discharged through bottom discharge port 26, and provides a liquid supply to the recirculation pump 18. A portion of the blended product also discharges from the separator top discharge port 24, through the product line 80, the selector valves 84, 86, and into the product tanks P1, P2.

It is important to note, however, that the blended product herein produced is essentially a slightly diluted concentrate. It is not to be inferred that the blended product comprises a final packaged product ratio of concentrate to diluent.

As the system 10 continues to operate, the concentrate from the barrel B is transferred to the product tanks P1, P2. Consequently, the level of concentrate in the barrel B is reduced. When the level of concentrate is near the bottom of the barrel B, the liner L will tend to separate from the wall of the barrel B. Separation of the liner L from the wall of the barrel B is, however, prevented by the use of the elastomeric retention band R. With the liner L secured in place, the concentrate is more efficiently removed from the barrel.

As the level of concentrate is reduced further, the liner L may tend to be drawn into the transfer manifold inlet port 38, and thus reduce or eliminate the flow of concentrate from the barrel B. Under certain circumstances, eliminating the flow of a liquid to a pump could adversely affect, or even damage the pump. This is also true of entrained air in the pump inlet stream. However, the present system uses an eductor pump to remove the concentrate from the barrel. Unlike a motive pump, an eductor pump is not adversely affected by a loss of suction flow, nor is an eductor pump adversely affected by entrained air in the inlet stream.

Nevertheless, the present system 10 reduces or eliminates the potential for a properly secured liner L to be drawn into the inlet port 38. As provided herein, the dish-shaped portion 44 of the manifold 14 is placed into the barrel B and rests on the bottom thereof. The spoke-like members 48 hold the liner L down, in place, against the barrel B bottom. At the same time, the fluid passages 50 provide sufficient flow area to maintain the velocity of the concentrate relatively low as the concentrate is drawn into the inlet port 38. Thus, the transfer manifold 14, which includes the unique dish-shaped portion 44, facilitates removal of almost all of the concentrate, while it also retains the liner in place on the bottom of the barrel.

As the system continues to operate, and the level of concentrate in the barrel B is still further reduced, air may become entrained in the stream entering the transfer manifold. However, as earlier provided, because the system 10 uses an eductor 20 in combination with a separator 22, and a recirculation pump 18, the entrained air does not pose a hydraulic problem for the system 10. Air which may become entrained in the system 10 is drawn into the eductor 20 along with the concentrate, the air is mixed with the liquid in the recirculation loop 12, and is discharged to the separator 22. In the separator 22, the blended product which is mixed with entrained air is discharged through the top discharge port 24 and is directed to the product tanks P1, P2 via the product line 80. From the separator bottom discharge port 26, a supply of liquid, relatively free of entrained air, is provided to the recirculation pump 18.

Essentially, the system 10, and particularly the recirculation loop 12 provides the ability to transfer liquid from a container or vessel to another container or vessel, which liquid may have air entrained therein. The motive force for transferring the liquid is provided indirectly by the recirculation pump 18, via the eductor 20 and separator 22. That is, the recirculation pump 18 provides the motive force for the eductor 20 which, in turn, hydrodynamically drives the transferred liquid. This arrangement allows the transferred liquid to include entrained air which would, in a typical motive pump arrangement, be deleterious to the motive pump. Here, however, the combined eductor 20 and recirculation pump 18 discharge streams are directed to the separator 22. The liquid which is discharged from the separator top discharge port 24, which may have air entrained therein, is directed to a second container or vessel, here, shown as the product vessels P1, P2. The liquid supplied to the recirculation pump 18, which is a motive pump, is discharged from the separator bottom discharge port 26 and is relatively free of entrained air.

As necessary during operation of the system 10, and as the concentrate level is reduced, the inner wall of the barrel B is sprayed with water to effectively remove the concentrate to the maximum extent practicable and to minimize waste. The water which is sprayed into the barrel B also serves as a diluent to the concentrate to produce the blended product.

Again, it is important to note that the blended product herein produced is essentially a slightly diluted concentrate. It is not to be inferred that the blended product comprises a final packaged product ratio of concentrate to diluent. Water is supplied to the system 10 from the hot and cold water supply lines 60, 62, through the on-off valves 64, 66, and through the pressure-reducing valve 68. The hose 69, which is connected at one end to reducing valve 68, and at the other end to the on-off valve 70, supplies water to the spray header inlet 54. Water spray is initiated and terminated by the on-off valve 70. The intensity of the water spray, vis-a-vis water flow and pressure, is adjusted by increasing or decreasing the flow area of the nozzle 56. The adjustment is readily made by changing the position of the nozzle block 58 relative to the spray header 52.

The most effective use of the water spray is made by using short burst cycles of water spray until the diluted concentrate flowing in the system 10 appears to be clear. The spray intensity is most effective when the water spray which strikes the barrel wall, coats the wall, and flows downward. It would be less effective if the water spray were to impinge the wall and to deflect off the wall into the barrel.

Once the transfer operation is completed, it may be desirable to operate the system 10 in the cleaning mode. The cleaning mode is shown in FIG. 2 in which the liquid flow path is indicated by darkened arrows, by operable valves which are open when shown unshaded, and by conversely operable valves which are closed when shown shaded.

It is contemplated that the cleaning mode will comprise a sequence of operative steps, which steps will be next addressed in succession. The liner L is first removed from the barrel B. Connections 100, 102, as shown in FIG. 1, which extend between the selector valves 84, 86 and the product tanks P1, P2, are disconnected from the tanks P1, P2, and reconnected to the cleaning line 82, as shown in FIG. 2. Typically, interconnecting piping between process steps is "hard-piped," that is, no hose connections are used. It is contemplated that clamp type connections would be used among the connections between the selector valves 84, 86, the tanks P1, P2, the cleaning line 82, and the product line 80. Such connections will be readily recognized by those skilled in the art.

Water is supplied to the barrel B from the water supply lines 60, 62, through the on-off valves 64, 66, the pressure reducing valve 68, and into the spray header inlet 54. The recirculation pump 18 is primed, and the recirculation loop 12 is placed in operation. The selector valve 74 is positioned to provide a flow path to the drain D.

The water which is discharged from the recirculation pump 18, through the eductor 20, draws the rinse water from the barrel B, through the transfer manifold 14, through the transfer hose 16, and into the eductor suction port 36. The water from the eductor 20 is discharged to the separator 22, where a portion of the water is discharged through the top discharge port 24, and a portion of the water is discharged though the bottom discharge port 26. The water which is discharged through the bottom discharge port 26 supplies a stream of water to the recirculation pump 18. The water which is discharged from the separator top discharge port 24 flows through the product line 80, the selector valves 84, 86, the cleaning line 82, and the cleaning recirculation valve 74, where the water is directed to the drain D, via the drain line 88. The rinse cycle is continued until the rinse water flowing to the drain D appears to be clear.

In the next step, hot water is supplied to the system 10, from water supply line 62, and the system 10 is operated for a sufficient period of time so that the hot water is circulated through the entire system 10. When the system 10 is appropriately heated, the cleaning recirculation valve 74 is positioned to isolate the drain line 88 and to recirculate the water through the system 10, via the recirculation hose 76, the check valve 78, and into the barrel B through spray header 52.

A chemical cleaning agent is next added to the system 10, such as by manually adding the cleaning agent through the top of the barrel B. The liquid in the system 10, which now comprises heated water and the cleaning agent is recirculated through the system 10. Recirculation continues until soils or contaminants which may have adhered to the components of the system 10, and to the barrel B, are removed therefrom and are carried through the system 10 in the recirculating liquid.

When the soils and contaminants are suspended and dissolved in the liquid, the cleaning recirculation valve 74 is positioned to isolate the spray header inlet 54 and direct the flow through the drain line 88 to the drain D. With the flow path configured in this manner, and with all water inputs to the system 10 isolated, the system 10 operates until the barrel B is empty.

Fresh rinse water is then supplied to the system 10 through water supply lines 60, 62, via the spray header inlet 54. When the rinse water flowing to the drain D appears to be clear, as observed at the drain D, the wash mode is complete. It is, however, recognized that a sanitizer may be added to the system 10 and recirculated and discharged in the same manner as the cleaning agent.

The present invention provides a readily cleaned barrel transfer system 10 for removing liquid contents from a barrel B, and transferring the contents to another storage unit, such as the exemplary product vessels P1, P2. It is recognized that the transfer container, such as the exemplary barrel B, may take many forms and shapes, such as lined containers, cartons, and the like. It is also recognized that the transferred liquid, such as the exemplary juice concentrate may also be of many types, including various relatively viscous food products, such as tomato ketchup, and the like.

From the foregoing, it will be observed that numerous modifications can be effected without departing from the true spirit and scope of the novel concepts of the present invention. It will be understood that no limitation with respect to the specific embodiment illustrated herein is intended or should be inferred. It is, of course, intended to cover by the appended claims all such modifications as fall within the scope of the claims.

What is claimed is:

1. A method of transferring a liquid from within a barrel comprising the steps of:

a. providing a barrel having therein a liquid;

b. providing a barrel transfer system having a transfer manifold, a recirculation loop including a recirculation pump, an eductor pump, and a separator, and means for providing flow communication between the transfer manifold and the recirculation loop;

c. pumping a liquid through the recirculation loop, from the recirculation pump, through the eductor pump, into the separator, wherein the pumping creates a low-pressure region in the eductor;

d. drawing the liquid from the barrel into the low-pressure region of the eductor and mixing the liquid from the barrel with the liquid in the recirculation loop to form a blended product; and e. discharging the blended product from the recirculation loop.

2. A transfer system for use with an associated barrel having a bottom and having a generally cylindrical shaped wall, the barrel having therein a liquid to be removed, the transfer system comprising:

a. a recirculation loop for providing flow communication and including a recirculation pump, an eductor pump, and a separator, the recirculation pump being a motive pump and being arranged to discharge a liquid through the eductor pump into the separator, and being supplied with liquid from the separator;

b. a transfer manifold having an inlet port and an outlet port and having a fluid conduit for providing flow communication between the inlet port and the outlet port, the inlet port being disposed in the barrel at about the bottom of the barrel and being shaped to define a plurality of fluid passages between the inlet port and the bottom of the barrel; and c. means for providing flow communication between the outlet port of the transfer manifold and the recirculation loop;

wherein the liquid in the recirculation loop is discharged from the recirculation pump through the eductor pump to provide a dynamic head to draw liquid from the barrel, through the transfer manifold, into the recirculation loop.

3. The transfer system of claim 2 wherein the transfer manifold further includes a concave, dish-shaped portion extending radially from about the inlet port, the dish-shaped portion being positioned to rest against the bottom of the barrel and being shaped to define a plurality of fluid passages between the inlet port and the bottom of the barrel.

4. The transfer system of claim 3 wherein the inlet port is frusto-conically shaped.

5. The transfer system of claim 3 wherein the dish shaped portion has a cone-shaped hub, a generally circular outer member, and a plurality of arcuate, upwardly extending, spoke-like members extending between the cone-shaped hub and the circular outer member, the spoke-like members defining a fluid passage between each spoke-like member and an adjacent spoke-like member.

6. The transfer system of claim 2 further including a spray header adjustably mounted to the fluid conduit between the inlet port and the outlet port and positionable to provide a spray of fluid therefrom.

7. The transfer system of claim 2 wherein the barrel has therein a liner having the liquid to be removed in the liner and an elastomeric band placed over the liner, the liner being in contact with the barrel, the elastomeric band securing the liner to the barrel.

8. A transfer manifold for use with a barrel transfer system, and with a barrel having a bottom and having a generally cylindrical shaped wall, the barrel having therein a liner, the transfer manifold comprising:

a. an inlet port;

b. an outlet port;

c. a fluid conduit for providing flow communication between the inlet port and the outlet port; and d. a concave, dish-shaped portion extending radially from about the inlet port, the dish-shaped portion being positioned to rest against the bottom of the barrel and to retain the liner in place between the dish-shaped portion and the bottom of the barrel, the dish-shaped portion being shaped to define a plurality of fluid passages between the inlet port and the bottom of the barrel.

9. The transfer manifold of claim 8 wherein the dish-shaped portion has a cone-shaped hub, a generally circular outer member, and a plurality of arcuate, upwardly extending, spoke-like members extending between the cone-shaped hub and the circular outer member, the spoke-like members defining a fluid passage between each spoke-like member and an adjacent spoke-like member.

10. The transfer manifold of claim 9 wherein the dish shaped portion is separable from the transfer manifold.

11. A transfer system for use with a first associated vessel or container, having therein a liquid to be transferred to a second associated vessel or container, the transfer system comprising:

a. a recirculation loop for providing flow communication and including a recirculation pump, an eductor pump, and a separator, the recirculation pump being a motive pump and being arranged to discharge a liquid through the eductor pump into the separator, and being supplied with liquid from the separator;

b. first means for providing flow communication between the first associated vessel or container and the recirculation loop; and c. second means for providing flow communication between the recirculation loop and the second associated vessel or container;

wherein the liquid in the recirculation loop is discharged from the recirculation pump through the eductor to provide a dynamic head to draw liquid from the first associated vessel or container into the recirculation loop, and wherein the liquid in the recirculation loop fills the separator and is discharged from the separator to the second associated container.

12. The transfer system of claim 10 wherein the first means for providing flow communication is a hose.

13. The transfer system of claim 10 wherein the second means for providing the flow communication is interconnecting piping.

* * * * *

UNITED STATES PATENT AND TRADEMARK OFFICE

CERTIFICATE OF CORRECTION

PATENT NO. : 5,398,733

DATED : March 21, 1995

INVENTOR(S) : Elmer S. Welch

It is certified that error appears in the above-indentified patent and that said Letters Patent is hereby corrected as shown below:

ON THE TITLE PAGE

Under References Cited, U.S. Patent Documents, for Beck, Patent No. "4,542,275" should be --4,542,775;

Column 3, line 38, (in heading) before "EMBODIMENTS", insert --PREFERRED--.

Signed and Sealed this

Fourth Day of July, 1995

Bruce Lehman

*Attest:*

BRUCE LEHMAN

*Attesting Officer*

*Commissioner of Patents and Trademarks*